US010145197B2

(12) United States Patent
Brown et al.

(10) Patent No.: US 10,145,197 B2
(45) Date of Patent: Dec. 4, 2018

(54) DOWNHOLE FISHING TOOL AND METHOD OF USE

(71) Applicants: Jeffrey J. Brown, Enid, OK (US); Henry F. Brown, Enid, OK (US)

(72) Inventors: Jeffrey J. Brown, Enid, OK (US); Henry F. Brown, Enid, OK (US)

( * ) Notice: Subject to any disclaimer, the term of this patent is extended or adjusted under 35 U.S.C. 154(b) by 266 days.

(21) Appl. No.: 15/335,115

(22) Filed: Oct. 26, 2016

(65) Prior Publication Data

US 2017/0044860 A1 Feb. 16, 2017

Related U.S. Application Data

(62) Division of application No. 14/556,877, filed on Dec. 1, 2014, now Pat. No. 9,528,339.

(60) Provisional application No. 61/912,256, filed on Dec. 5, 2013.

(51) Int. Cl.

| | |
|---|---|
| ***E21B 33/129*** | (2006.01) |
| ***E21B 31/00*** | (2006.01) |
| ***E21B 31/12*** | (2006.01) |
| ***E21B 47/09*** | (2012.01) |
| ***E21B 33/12*** | (2006.01) |
| ***E21B 33/126*** | (2006.01) |
| ***E21B 23/01*** | (2006.01) |
| *E21B 23/00* | (2006.01) |
| *E21B 43/12* | (2006.01) |

(52) U.S. Cl.

CPC ..... *E21B 31/12* (2013.01); *E21B 23/01* (2013.01); *E21B 33/12* (2013.01); *E21B 33/1265* (2013.01); *E21B 47/09* (2013.01); *E21B 23/006* (2013.01); *E21B 43/12* (2013.01)

(58) Field of Classification Search

CPC .. E21B 23/06; E21B 33/1292; E21B 33/1295; E21B 33/1294; E21B 33/1293; E21B 33/129; E21B 33/1291

See application file for complete search history.

(56) References Cited

U.S. PATENT DOCUMENTS

| | | | | |
|---|---|---|---|---|
| 2,743,780 A * | 5/1956 | Brown | ..... | E21B 33/12955 166/120 |
| 4,951,750 A * | 8/1990 | Wetzel, Jr. | ..... | E21B 37/08 166/278 |
| 2002/0195253 A1 * | 12/2002 | Hill, Jr. | ..... | E21B 21/10 166/380 |

* cited by examiner

*Primary Examiner* — Kipp C Wallace
(74) *Attorney, Agent, or Firm* — Hall Estill Law Firm

(57) ABSTRACT

The present disclosure is directed toward a downhole tool used to free stuck tools in a wellbore and the method of using the downhole tool. The downhole tool includes at least one packer element for engaging a casing in a wellbore. The packer works to isolate one area of the casing from another. The downhole tool also includes at least one slip element for engaging the casing to maintain the position of the downhole tool in the casing or wellbore. Further, the downhole tool includes a mandrel slidably disposed within the at least one packer element and the at least one slip. The mandrel includes at least one port disposed therein above the at least one packer element when the mandrel is in a first position.

8 Claims, 4 Drawing Sheets

DOWNHOLE FISHING TOOL AND METHOD OF USE

CROSS-REFERENCE TO RELATED APPLICATIONS

The present application is a divisional application of U.S. patent application having U.S. Ser. No. 14/556,877, filed Dec. 1, 2014, which is a conversion of U.S. Provisional Application having U.S. Ser. No. 61/912,256, filed Dec. 5, 2013, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present invention relates to downhole oil and gas tool for removing stuck tools from a wellbore and a method of removing stuck tools from a wellbore.

2. Description of the Related Art

In standard downhole tool retrieving operations under high hydrostatic pressure, downhole tools, such as drill pipe and drilling motors (and/or other types of downhole tools) attached below the drill pipe, can get stuck in a wellbore. It is not uncommon for drill pipe and drilling motors disposed below the drill pipe to get stuck and left in a wellbore because operations to retrieve them are unsuccessful. This is very problematic because drilling motors are very expensive tools. In these situations, the drill pipe is stuck causing the drilling motor to be stuck in the well and options for removing a downhole tool from a wellbore that is stuck on the bottom are very limited.

Accordingly, there is a need for a downhole tool that can be used to operate in a fluid filled wellbore under very high hydrostatic pressure conditions that is capable of effectively recovering drill pipe and other downhole tools attached thereto that are stuck at, near or on the bottom of the well.

SUMMARY OF THE DISCLOSURE

The present disclosure is directed toward a downhole tool that includes at least one packer element for engaging a casing in a wellbore. The packer works to isolate one area of the casing from another. The downhole tool also includes at least one slip element for engaging the casing to maintain the position of the downhole tool in the casing or wellbore. Further, the downhole tool includes a mandrel slidably disposed within the at least one packer element and the at least one slip. The mandrel includes at least one port disposed therein above the at least one packer element when the mandrel is in a first position.

The present disclosure is also directed to a method of freeing stuck tools in a well. A first area inside the casing is sealed off from a second area in the casing. A part of the downhole tool is attached to the tool that is stuck in the wellbore. A substantial amount of fluid can be removed from the second area of the casing. The stuck tool can then be freed from the wellbore.

DETAILED DESCRIPTION OF THE DISCLOSURE

Figure 1:
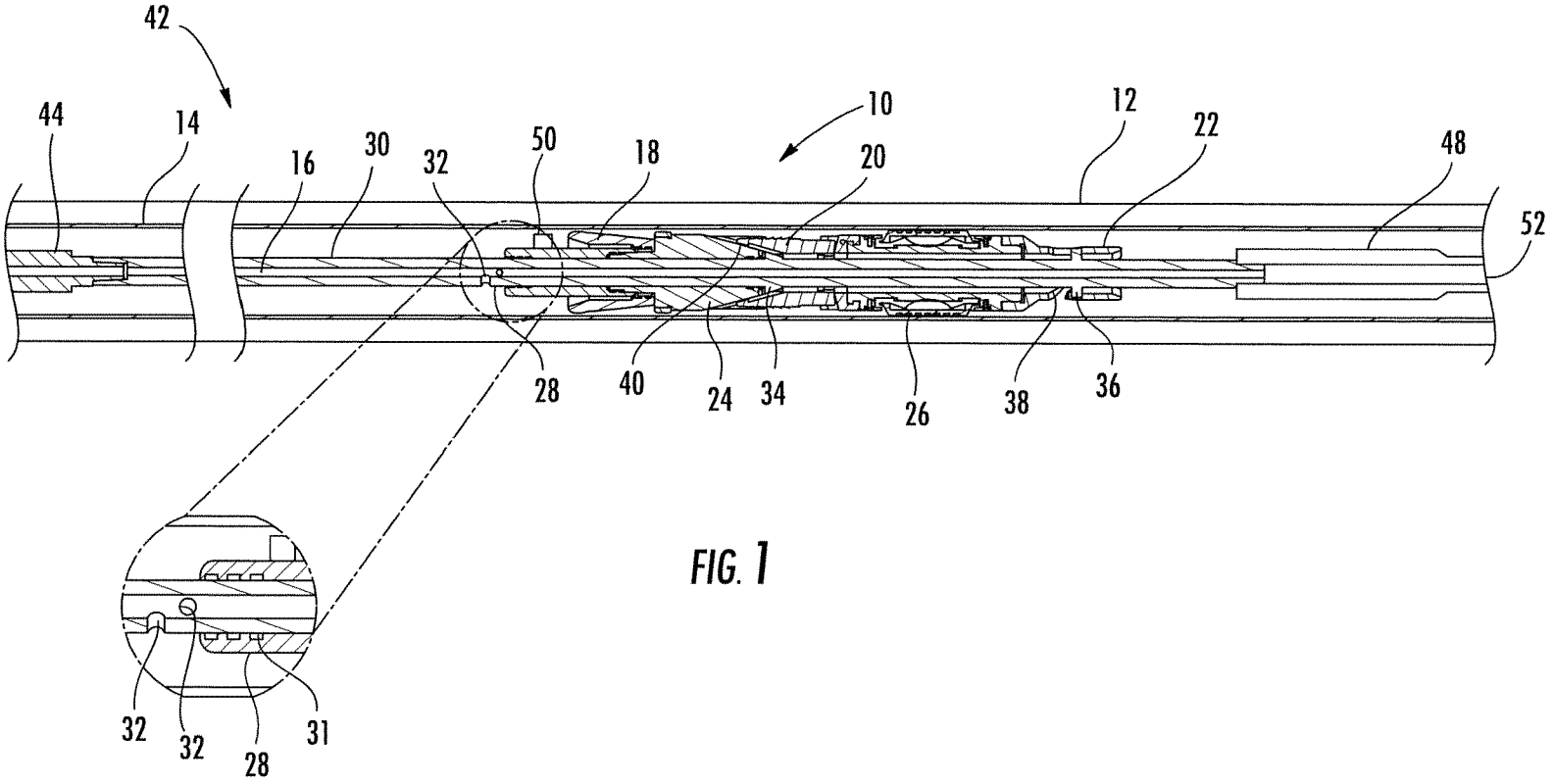
FIG. 1 is a cross-sectional view of a downhole tool constructed in accordance with the present disclosure.
Figure 2:
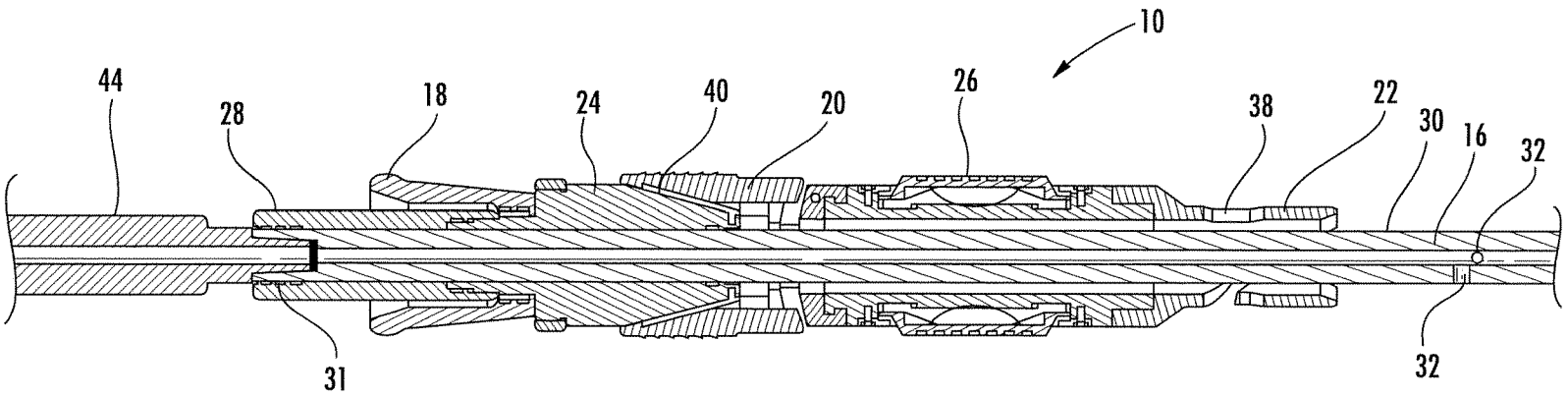
FIG. 2 is a cross-sectional view of the downhole tool constructed in accordance with the present disclosure.
Figure 3:
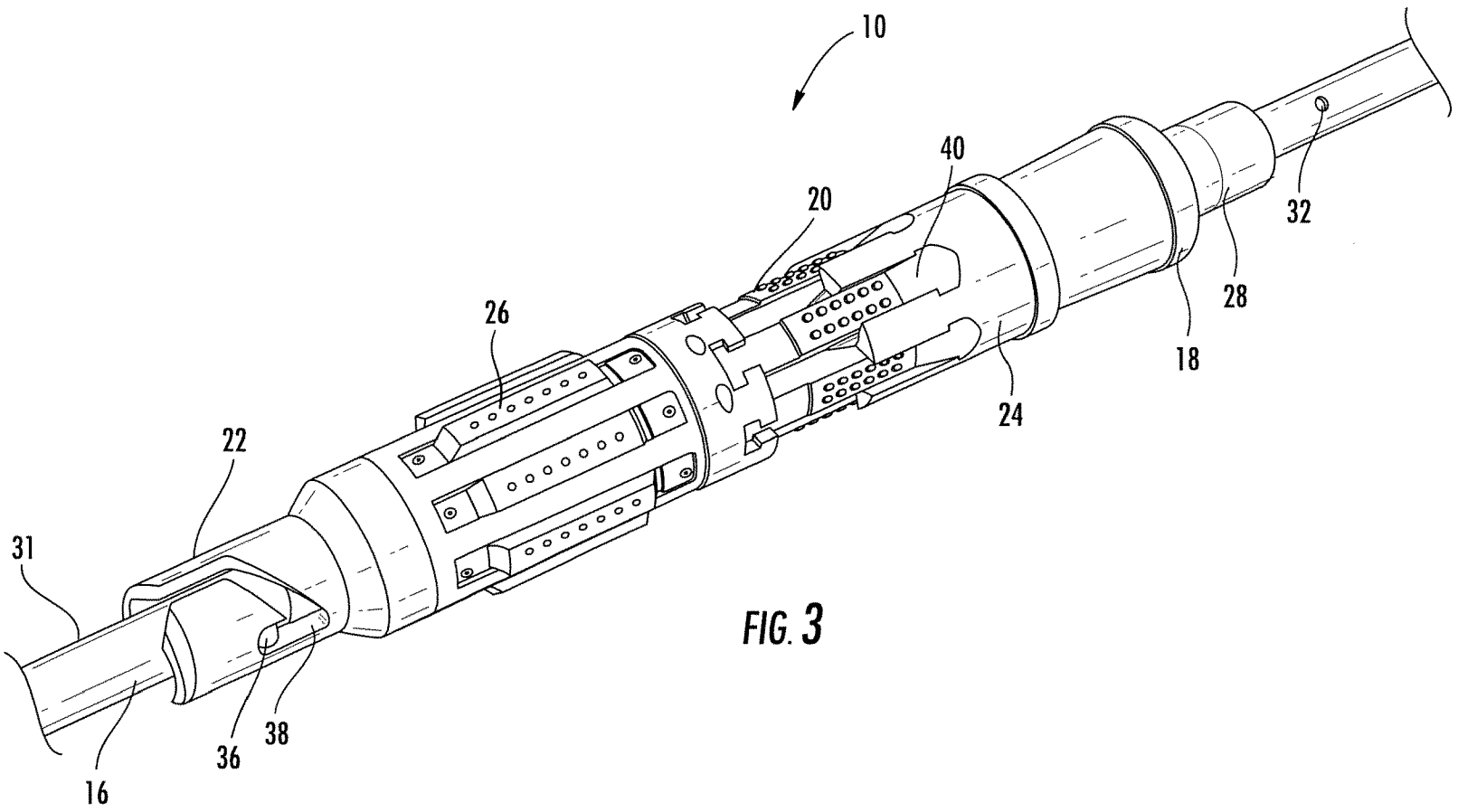
FIG. 3 is a perspective view of one embodiment of a portion of the downhole tool constructed in accordance with the present disclosure.
Figure 4:
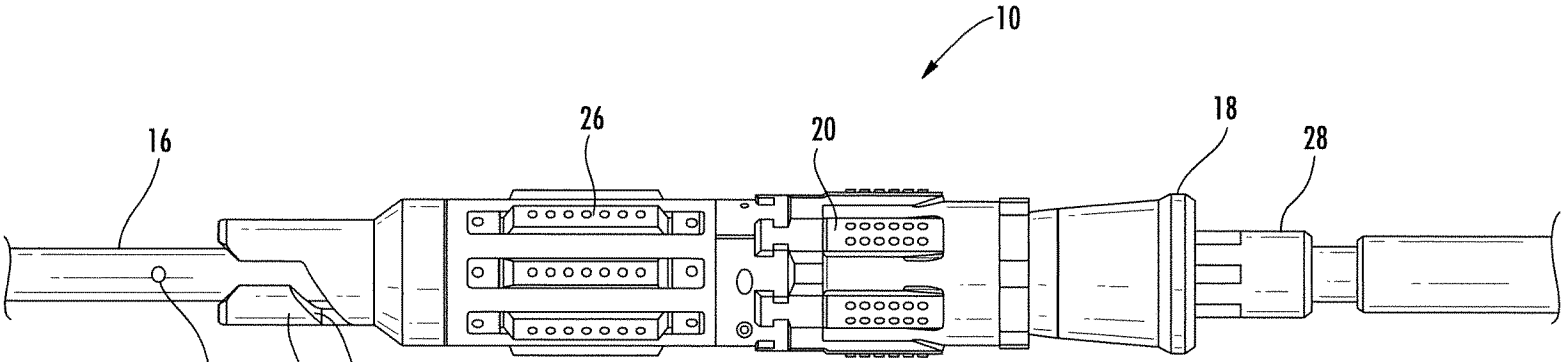
FIG. 4 is a side elevation view of one embodiment of a portion of the downhole tool constructed in accordance with the present disclosure.

The present disclosure, as shown in FIGS. 1-4, relates to a downhole tool 10 (or fishing tool) for retrieving stuck tools, such as drill pipe, any downhole tools attached thereto, and/or any other types of downhole tools, in a wellbore 12 and a method for retrieving stuck tools from the wellbore 12. In certain situations, the wellbore 12 has a casing 14 installed therein. FIG. 1 shows the downhole tool 10 configured as it would be as the downhole tool 10 is run into the wellbore 12. The downhole tool 10 includes a mandrel 16 for supporting various other parts of the downhole tool 10, at least one packer element 18 (such as a cup type packer element) disposed adjacent to the mandrel 16 for hydraulically sealing an area of the casing 14 above the downhole tool 10 from another area of the casing 14 below the downhole tool 10, and at least one slip element 20 disposed adjacent to the mandrel 16 for maintaining a position of the at least one packer element 18 in the well. The downhole tool 10 also includes a mandrel support element 22 for selectively supporting the mandrel 16 in a first position.

In another embodiment, the downhole tool 10 can includes at least one slip wedge 24 disposed adjacent to the mandrel 16 and the at least one slip element 20. The downhole tool 10 can also include at least one friction element 26 for frictionally engaging the casing 14 and helping temporarily hold the downhole tool 10 in a predetermined location in the wellbore 12/casing 14. The downhole tool 10 can further include a sealing member 28 for sealing between an outside portion 30 of the mandrel 16 and the other parts of the downhole tool 10. The sealing member can include sealing elements 31 to promote the sealing between the outside portion 30 of the mandrel 16 and the other parts of the downhole tool 10.

The downhole tool 10 can have a plurality of slip elements 20 disposed around a portion of the mandrel 16. Each slip element 20 can be a button slip that includes at least one button disposed therein/thereon, a wicker slip with a plurality of wickers, or a combination thereof. For each slip element 20 that the downhole tool 10 has the slip wedge 24 will have a corresponding slip area 40 where each slip element 20 will engage the slip wedge 24 forcing the slip elements 20 toward the casing 14 when the downhole tool 10 is put in use.

The mandrel 16 can include at least one port 32 for allowing fluid to pass into and out of the mandrel 16, a wedge portion 34 disposed adjacent to the at least one slip element 20 to force the at least one slip element 20 toward the casing 14 when the mandrel 16 is forced downward and through the downhole tool 10, and an extension element 36 capable of selectively engaging the mandrel support element 22 to maintain the mandrel 16 in the first position in the well. The at least one port 32 is positioned above the at least one packer element 18 when the mandrel 16 is in the first position. The mandrel 16 can have a predetermined Length L such that the at least one port 32 can be positioned a predetermined distance below the downhole tool 10 when the mandrel 16 is in a second position. When the mandrel 16 is in the first position, the at least one port 32 permits the fluid in the wellbore 12/casing 14 to flow into the mandrel 16 and through the mandrel 16 which allows the downhole tool 10 to move more easily through the fluid in the wellbore 12/casing 14.

The mandrel support element 22 includes at least one slot 38 for receiving the extension element 36 attached to the mandrel 16. In one embodiment, the at least one slot 38 can be a J-shaped slot wherein the extension element 36 attached to the mandrel 16 can set in the at least one slot 38 and maintain the mandrel's position within the downhole tool 10.

In further embodiments, the downhole tool 10 can be included in a bottom hole assembly (BHA) 42. In one embodiment, the BHA 42 can include a hydraulic tool 44 for controlling the flow of fluid up into a drill string (not shown) and/or a perforated sub 48 to allow fluid flow into the mandrel 16 when the at least one port 32 is positioned above the at least one packer element 18 and the perforated sub 48 is attached to a stuck tool that is to be removed from the wellbore 12. In one embodiment, the mandrel 16 can be adapted to have perforations (not shown) below the at least one packer element 18 (when the mandrel 16 is in the first position) and be adapted to be connectable to the stuck tool. In another embodiment, the BHA 42 can include any tool know in the art for attachment to the mandrel 16 or the perforated sub 48 and the stuck tool in the wellbore 12.

In a further embodiment of the present disclosure, the downhole tool 10 or the BHA 42 includes a location detection device 50 for determining the location and/or depth of the downhole tool 10, or more specifically, the at least one packer element 18. The location detection device 50 can be any type of device known in the art for determining the location and/or depth of the downhole tool 10 in the wellbore 12. The location detection device 50 can be wired or wireless.

Figure 5:
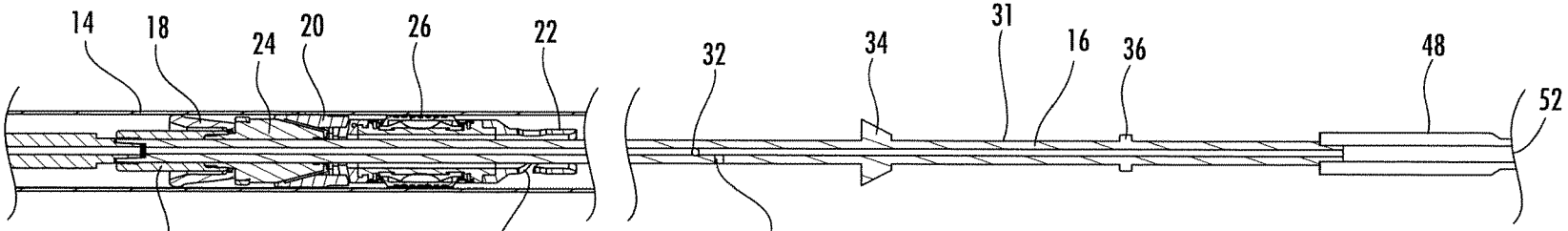
FIG. 5 is a cross-sectional view of another embodiment of the downhole tool constructed in accordance with the present disclosure.

FIG. 1 shows the downhole tool 10 and the BHA 42 in a first position, or the position of the downhole tool 10 and the BHA 42 when run down into the wellbore 12. FIG. 5 shows the downhole tool 10 and the BHA 42 in a second position (or in a fishing position). In use, the downhole tool 10 is run down into the wellbore 12 until a part of the downhole tool 10 or the BHA 42 contacts the stuck tool in the wellbore 12. The depth and/or location of the stuck tool can be determined by the location detection device 50 based upon the distance of the location detection device 50 from a downhole end 52 of the downhole tool 10 or the BHA 42. Once the location of the stuck tool is determined in the wellbore 12, the downhole tool 10 and/or BHA 42 is positioned a predetermined distance above the stuck tool responsive to the length L of the mandrel 16.

After the downhole tool 10 and/or the BHA 42 is positioned at the predetermined distance above the stuck tool, the extension element 36 of the mandrel 16 is removed from the at least one slot 38 of the mandrel support element 22, which permits the mandrel 16 to slide down through the downhole tool 10 and permits the downhole end 52 of the downhole tool 10 or the BHA 42 to be extended down and connect to the stuck tool. The downhole tool 10 (with the exception of the mandrel 16) maintains its position in the wellbore 12/casing 14 while movement of the mandrel 16 is initiated through the downhole tool 10 by the at least one friction element 26 frictionally engaging the casing 14. Once the extension element 36 of the mandrel 16 is out of the at least one slot 38 of the mandrel support element 22 and movement of the mandrel 16 is initiated downward in the wellbore 12, the wedge portion 34 of the mandrel 16 forces the at least one slip element 20 outward toward the casing 14. The weight of the fluid in the wellbore above the at least one packer element 18 forces the at least one packer element 18 and the slip wedge 24 downward. The outward movement of the at least one slip element 20 and the downward movement of the slip wedge 24 permits the slip wedge 24 to engage the at least one slip element 20 and cause the at least one slip element 20 to engage the casing 14 such that the downhole tool 10 does not move downward in the casing 14. The at least one slip element 20 securely engaged in the casing 14 permits the weight of the fluid in the wellbore above the at least one packer element 18 to engage the casing 14 such that fluid is not permitted to flow below the at least one packer element 18. FIG. 5 shows the at least one packer element 18 contacting the casing 14. This permits the area in the casing 14 above the downhole tool 10 to be hydraulically sealed from the area in the casing 14 below the downhole tool 10. More specifically, the area in the casing 14 above the at least one packer element 18 is hydraulically sealed from the area in the casing 14 below the at least one packer element 18.

The downhole end 52 of the downhole tool 10 or the BHA 42 then moves down the wellbore 12 a predetermined distance (10-30 feet for example) and connects to the stuck tool. The at least one port 32 in the mandrel 16 is now positioned below the at least one packer element 18 (and the other components of the downhole tool 10). The location and/or depth of the downhole tool 10 is monitored via the location detection device 50 to ensure that the downhole tool 10 is securely set and the downhole tool 10 does not move downward when the mandrel 16 is moved downward. It should be understood that the hydrostatic pressure/weight of the fluid in the wellbore 12 is the same above and below the at least one packer element 18 of the downhole tool 10 and, thus, the hydrostatic pressure/weight of the fluid is also on the stuck tool.

After the downhole end 52 is connected to the stuck tool and the at least one packer element 18 is set, the hydraulic tool 44 can be actuated to allow the fluid in the wellbore 12 below the at least one packer element 18 to be forced into the drill string via the at least one port 32 of the mandrel 16 and the mandrel 16. Once the fluid below the at least one packer element 18 is permitted to flow out of the wellbore, the hydrostatic pressure/weight of the fluid remaining below the at least one packer element is substantially less than before the hydraulic tool 44 was opened. Thus, the hydrostatic pressure/weight on the stuck tool from the fluid is significantly less. This allows for a much more significant pull on the stuck tool. More specifically, if a large portion of the fluid was removed from the wellbore below the at least one packer element 18, the hydrostatic pressure/weight on the stuck tool is significantly reduced, which allows the pull from the surface to be increased by the hydrostatic pressure/weight reduction of pulling the fluid from below the at least one packer element 18.

In one embodiment of the present disclosure, the hydraulic tool 44 has a predetermined amount of time before it opens once it is actuated. For example, the hydraulic tool 44 may be set up to open after three minutes, or five minutes, etc. once the hydraulic tool 44 is actuated. In another embodiment, the hydraulic tool 44 is actuated when the downhole end 52 is engaged with the stuck tool and the weight of the drill string in the wellbore 12 is allowed to set down on the stuck tool. It should be understood and appreciated that any hydraulic tool 44 can be used and any method of actuating the hydraulic tool 44 can be used.

Once the stuck tool is no longer stuck the mandrel 16 is pulled back up and through the downhole tool 10 into the first position. When this occurs, the wedge portion 34 of the mandrel 16 contacts the slip wedge 24 and forces the slip wedge 24 upward and allows the at least one slip element 20 to be disengaged from the casing 14. When the mandrel 16 is back in the first position, the at least one port 32 positioned back above the at least one packer element 18 which permits fluid above the downhole tool 10 to flow into and through the mandrel 16 into the wellbore 12 below the at least one packer element 18. This allows the fluid pressure/weight to equalize in the wellbore 12 and across the downhole tool 10. The equalization of fluid pressure/weight across the downhole tool 10 will permit the at least one packer element 18 to disengage from the casing 14 and permit the downhole tool 10 and the stuck tool to be pulled up to the surface more easily.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A method, the method comprising:

sealing a first area inside a casing in a wellbore from a second area in the casing;

attaching a part of a fishing tool to a stuck tool in the wellbore, the fishing tool comprising:

at least one packer element for engaging a casing in a wellbore to isolate the first area in the casing from the second area;

at least one slip element for engaging the casing and maintaining a position of the fishing tool in the wellbore; and a mandrel slidably disposed within the at least one packer element and the at least one slip element, the mandrel having at least one port disposed therein above the at least one packer element when the mandrel is in a first position in the fishing tool and the at least one port disposed in the mandrel is disposed below all components of the at least one packer element when the mandrel is in a second position, the mandrel being fluidically open when the mandrel is in the first and second position;

removing a substantial amount of fluid from the second area in the casing; and freeing the stuck tool from the wellbore.

2. The method of claim 1 further comprising the steps of determining a location of the stuck tool and positioning the fishing tool a predetermined distance from the stuck tool.

3. The method of claim 2 further comprising the step of extending the part of the fishing tool to be attached to the stuck tool.

4. The method of claim 2 further comprising the step of pulling on the stuck tool.

5. The method of claim 1 wherein the mandrel has a second position and includes a wedge portion to force the at least one slip element toward the casing when the mandrel moves from the first position to the second position, the at least one port in the mandrel is disposed below the at least one packer element in the second position.

6. The method of claim 5 wherein the fishing tool further includes a mandrel support element selectively supporting the mandrel in the first position.

7. The method of claim 1 wherein the fishing tool is included in a BHA, the BHA further includes a hydraulic tool for permitting fluid to enter a drill string attached to the BHA when the mandrel is in the second position.

8. The method of claim 1 wherein the fishing tool includes at least one friction element to maintain a position of the fishing tool in the wellbore prior to the at least one slip element engaging the casing.

* * * * *